US005812680A

United States Patent [19]

Glendon

[11] Patent Number: 5,812,680

[45] Date of Patent: Sep. 22, 1998

[54] HEARING AID APPARATUS

[76] Inventor: Douglas H. Glendon, 15 Chestnut St., North Reading, Mass. 01864

[21] Appl. No.: 676,573

[22] Filed: Jul. 8, 1996

[51] Int. Cl.[6] ..... H04R 25/00

[52] U.S. Cl. ..... 381/69; 381/68.6; 381/69.2

[58] Field of Search ..... 381/60, 68, 68.5, 381/68.6, 68.7, 69, 69.2, 68.2, 68.3, 68.4, 23.1

[56] References Cited

U.S. PATENT DOCUMENTS

| | | | |
|---|---|---|---|
| D. 176,512 | 1/1956 | Hagedorn et al. . | |
| 2,477,046 | 7/1949 | Davenport . | |
| 2,506,116 | 5/1950 | Starkey . | |
| 2,595,672 | 5/1952 | Greenwood . | |
| 2,909,619 | 10/1959 | Hollingsworth | 381/68.6 |
| 3,068,954 | 12/1962 | Strzalkowski | 381/68.6 |
| 3,598,928 | 8/1971 | Hickox | 381/68.6 |
| 5,327,499 | 7/1994 | Sohayda | 381/68.6 |
| 5,365,593 | 11/1994 | Greenwood et al. | 381/69 |

FOREIGN PATENT DOCUMENTS

| | | | |
|---|---|---|---|
| 0673365 | 2/1990 | Switzerland | 381/68 |

*Primary Examiner*—Huyen D. Le

[57] ABSTRACT

An improved earring-style hearing aid includes a tongue-shaped mold that fits along the bottom of the ear canal, leaving the ear canal substantially unfilled, and that delivers to the eardrum amplified sound that is received through a removably attachable connector from a combination microphone and amplification circuit that is attached to the ear lobe and that can be configured using one of many different covers to take the appearance of one of many different earrings.

18 Claims, 6 Drawing Sheets

HEARING AID APPARATUS

BACKGROUND OF THE INVENTION

The present invention relates to an improved earring-style hearing aid.

A hearing aid user typically desires a hearing aid that is not conspicuous when worn. A hearing aid that is conspicuous when worn makes apparent the wearer's need for a hearing aid and is therefore typically perceived as unattractive by a hearing aid user. This perception has led to various attempts to make hearing aids less conspicuous and thus more attractive. For example, U.S. Pat. No. 2,909,619 to Hollingsworth discloses a decorative device that is clipped to and hides a hearing aid case that is suspended from the earlobe of the wearer.

More recently, as hearings aids have become smaller through the miniaturization of parts, it has become possible to place the majority of the hearing aid, including the hearing aid's microphone and amplifier output components, substantially out-of-sight within the ear or within the ear canal. However, this places the microphone close to the amplifier output, which often results in feedback of the output signal back into the microphone, which reduces the effectiveness of the hearing aid. Furthermore, so placing the hearing aid typically results in occlusion, which further reduces the effectiveness of the hearing aid.

In addition, a hearing aid, such as that disclosed by Hollingsworth or that disclosed in U.S. Pat. No. 2,506,116 to Starkey, that fills, or nearly fills, the canal with solid components, has a high risk of damage to the ear. Such damage can occur when the hearing aid receives a glancing or direct force of impact from, for example, a fall by the wearer or a snag of clothing or jewelry on an exposed portion of the hearing aid.

SUMMARY OF THE INVENTION

The invention is based on the discovery that an attractive, effective, safer hearing aid can be obtained if a cosmetically attractive amplifier housing outside the ear canal is removably connected to an ear-canal sound conduit by a connector that transmits sound effectively.

In one aspect, the invention features a hearing aid that includes an amplifier configurable to be positioned outside the ear canal, the amplifier configurable to receive a signal for producing an amplified signal, a connector configurable to receive the amplified signal for conducting the amplified signal, the connector having an inner member and an outer member, the inner member being removably insertable into the outer member, the connector being able to conduct the amplified signal when the inner member is at least partially inserted into the outer member, and a conduit configurable to extend into the ear canal, the conduit configurable to receive the amplified signal from the connector for conducting the amplified signal to an area proximal to the eardrum.

Implementations of this aspect of the invention may include one or more of the following features.

The amplifier, when physically connected to the conduit, may be able to be completely physically disconnected from the conduit by applying a force to the amplifier, the force being sufficient to remove the inner member from the outer member. The amplifier's disconnectability from the conduit may be sufficient to prevent the force applied to the amplifier from causing an injury proximal to the conduit.

The amplified signal may include sound pressure waves and the connector may conduct sound pressure waves.

The hearing aid may further include a pin configurable to attach the amplifier to the earlobe, the pin being at least vertically movable with respect to the amplifier. The conduit may include a flexible plastic material. A substantial portion of the conduit may be configurable to fit along the bottom of the ear canal, the ear canal thus being left substantially unfilled, the conduit substantially filling the ear canal only at the area proximal to the eardrum. The conduit may include a tube for conducting the amplified signal to the area proximal to the eardrum.

The inner member may include a flexible plastic material and the outer member may include a funnel-like ridge that facilitates insertion of the inner member into the outer member.

In another aspect, the invention features a hearing aid connector for conducting sound pressure, the connector including an outer member connecting to a first tube, the first tube configurable to carry sound pressure, and an inner member enclosing a second tube, the second tube configurable to carry sound pressure, the inner member being removably insertable into the outer member.

Implementations of this aspect of the invention may include one or more of the following features.

The inner member may include a first plastic material and the outer member may include a second plastic material, the first plastic material being more flexible than the second plastic material. The inner member and the outer member may be substantially cylindrical in shape, each member having at least one tapered end. The connector may be able to conduct sound pressure without significant leakage when the inner member is at least partially inserted into the outer member. The outer member may include a funnel-like ridge that facilitates insertion of the inner member into the outer member. The inner member may include a ridge that provides sliding resistance when the inner member is fully inserted into the outer member.

The inner member may be hollow and the diameter of the inner member may be substantially the same as the diameter of the outer member. The diameters of the tubes may be substantially similar and may be substantially smaller than the diameters of the inner and outer members.

In another aspect, the invention features a hearing aid that includes an amplifier configurable to be positioned outside the ear canal, the amplifier configurable to receive a signal for producing an amplified signal, a sound-conducting connector configurable to receive the amplified signal for conducting the amplified signal, a conduit configurable to extend into the ear canal, the conduit configurable to receive the amplified signal from the connector for conducting the amplified signal to an area proximal to the eardrum, and cosmetic jewelry concealing the amplifier, the connector, and the conduit.

Implementations of this aspect of the invention may include one or more of the following features.

The cosmetic jewelry may include a hearing aid cover for the amplifier, the cover including an earring portion and a connector portion for removably attaching the earring portion onto the amplifier. The amplifier may further include a microphone opening and the cover may further include a cover opening corresponding to the microphone opening.

The connector portion may include threads for removably screwing the earring portion onto the amplifier and the cover opening may align with the microphone opening when the connector portion is fully screwed onto the amplifier. The cover may include injection-molded plastic or a gemstone and may be selected from a group consisting of a plurality of covers, each cover in the group having an appearance that is unique within the group. Each cover in the group may correspond to an actual earring that matches the cover in appearance.

The invention provides several advantages. A hearing aid is provided that is less conspicuous and more attractive when worn because the exposed portion of the hearing aid has the appearance of an attractive earring and hides the inner-ear portion of the hearing aid. The appearance, including the color, of the exposed earring portion of the hearing aid can be easily changed, which makes the hearing aid less conspicuous by providing for aesthetic variety and allowing fashion coordination. Feedback of the amplified output signal back into the microphone is reduced. The risk of injury resulting from a glancing or direct force of impact on the exposed portion of the hearing aid is reduced. The risk is reduced by providing a removably attachable connector between the exposed portion of the hearing aid and the inner-ear portion of the hearing aid. The risk is further reduced by providing a stud-pin that gives way under such a force of impact.

Other features and advantages of the invention will become apparent from the following description and claims.

DESCRIPTION OF THE PREFERRED EMBODIMENTS

Figure 1:
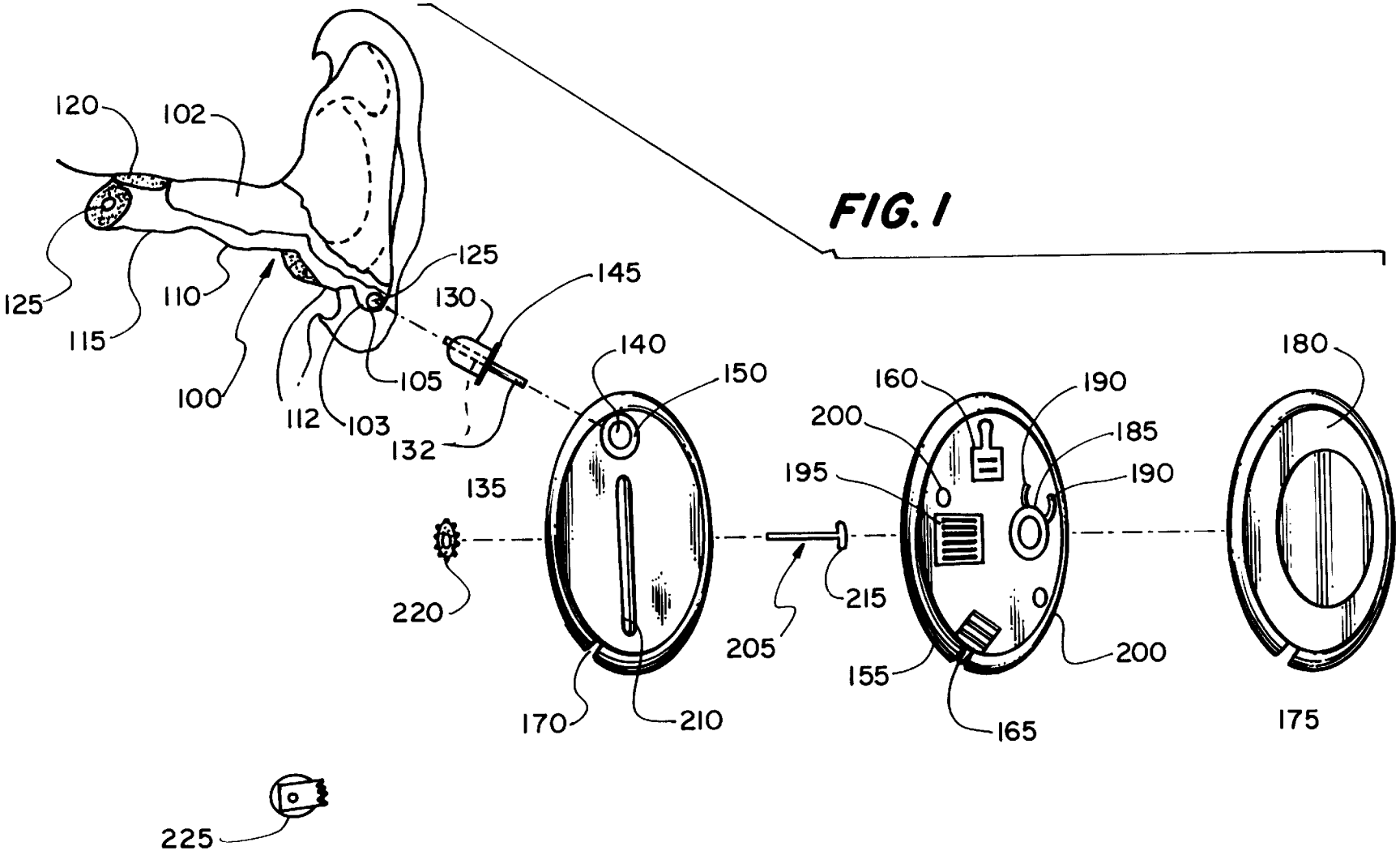
FIG. 1 is a somewhat diagrammatic view of a human ear and a disassembled earring hearing aid according to the invention.
Figure 2A:
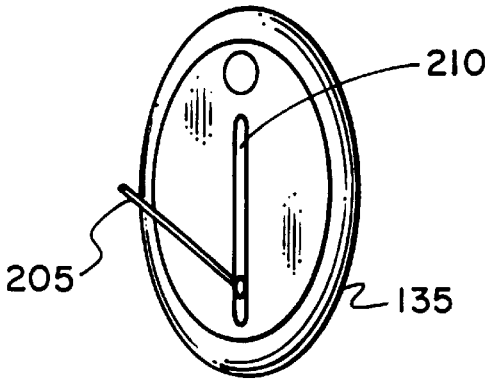
FIGS. 2A, 2B and 2C are somewhat diagrammatic views of an embodiment of a stud-pin and housing assembly according to the invention, with the stud-pin displaced to different orientations relative to the housing.
Figure 2B:
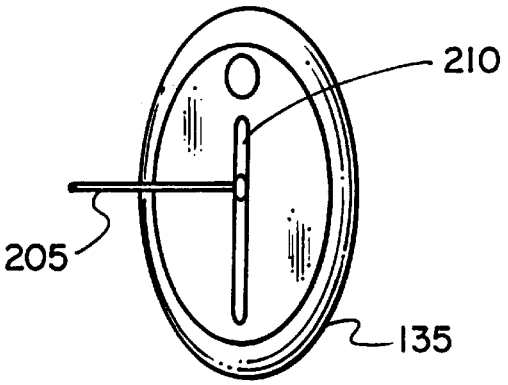
Figure 2C:
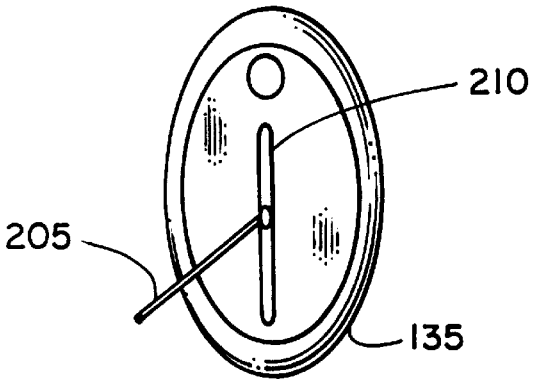
Figure 2D:
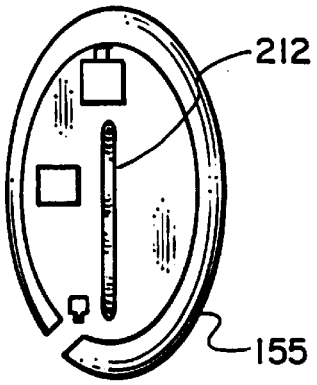
FIGS. 2D and 2E are similar somewhat diagrammatic views of the stud-pin and housing, respectively.
Figure 2E:
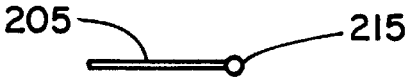

The invention is based on the discovery that an attractive, effective, safer hearing aid can be obtained if a cosmetically attractive amplifier housing outside the ear canal is removably connected to an ear-canal sound conduit by a connector that transmits sound effectively. With reference to FIG. 1, in a preferred embodiment of the invention, the conduit is a plastic mold 100 that is insertable into the auditory canal 102 of the outer ear. The mold is preferably custom-made, using a flexible material such as lucite or vinyl-flex preferably having a color that helps to camouflage the mold after insertion. When the mold is inserted, the outermost portion 103 of the mold appears at the intertragal notch 105 of the outer ear. The mold has a thin tongue-shaped portion 110 that runs along the bottom side of the concha bowl 112 and auditory canal 102 of the ear. Near the eardrum, the innermost portion 115 of the mold has a cylindrical shape and nearly completely fills a small portion of the canal. This cylindrical portion 115 of the mold provides a channel vent 120 on the top side of the mold to allow venting of sound pressure. The cylindrical portion of the mold is also preferably coated using both hardcoat and softcoat ultraviolet treatments to reduce sound leakage back through the ear canal, which can cause feedback.

In a preferred embodiment in which sound is transmitted through the mold as sound pressure waves, the mold includes a hollow plastic receiver tube 125 that is enclosed within the tongue-shaped mold. Preferably the tube is an industry-standard in-the-ear hearing-aid tube that is approximately 0.0625 inches in diameter. The tube 125 extends from the intertragal notch 105 to the bony area of the auditory canal at the cylindrical portion 115 of the mold.

In this preferred embodiment of the invention, the majority of the auditory canal 102 of the outer ear is not filled with ear mold material. Rather, the ear mold 100 fills only a small portion of the canal along the bottom of the auditory canal and concha bowl area. Thus, any sound leakage escaping through the channel vent 120 passes through the largely unfilled auditory canal 102 and disperses into the atmosphere without creating feedback.

A break-away rubber-like nipple 130, described in more detail below, fits securely to the mold 100 at the intertragal notch 105. The nipple is preferably hollow and includes an extension 132 of the receiver tube 125, connecting the mold 100 with a hearing aid body housing 135. The break-away nipple connects into the body housing 135 through a female receptacle 140. In addition, the break-away nipple has a nipple ridge or groove 145 that fits into a corresponding housing groove 150 that is on the body housing 135 and that is around the female receptacle 140. The grooves 145, 150 operate to hold the break-away nipple in place. Preferably, the break-away nipple is soft, flexible, and bends easily. A glancing force of impact exerted upon the housing 135 causes the nipple 130 to give way or break off from the mold 100. A direct force of impact that pushes the body housing 135 towards the eardrum causes the break-away nipple 130 to squish or collapse. Thus the delicate parts of the ear canal and eardrum are isolated from the impact. Together, the flexible nature of the ear mold and the break-away nature of the nipple operate to protect the ear from impact damage.

The housing 135, which is preferably about 0.875 inches in diameter and preferably about 0.2 inches in thickness, houses a removable circuit holder 155. The circuit holder preferably snaps firmly and removably into the housing using pre-formed grooves. The circuit holder houses microelectronic components. Pre-formed indentations are used in the circuit holder to hold preferably all of the electronic components, which are preferably standard components used in existing in-the-canal hearing aids for treating moderate to severe hearing loss. A commonly-available small battery of a type such as #10, #312, or #5A is preferably used.

In this preferred embodiment, some of the electronic components are placed such that the circuit holder 155 fits into the housing 135 in only one way. Thus, the proper placement of an electronic receiver component 160 and a microphone component 165 into the circuit holder is important in this embodiment. Unless both of these components 160, 165 are placed properly, the housing 135 and the circuit holder 155 do not fit together properly. The microphone 165 preferably aligns with an opening 170 of the housing. An earring cover 180, described in more detail below, has a corresponding opening 175, which also preferably aligns with the microphone 165. Similarly, the electronic receiver component 160 preferably aligns with the female receptacle 140. Preferably both the electronic receiver 160 and the microphone 165 include rubber-like gaskets to contain internal feedback.

Other components are placed in the circuit holder 155 in a configuration accommodated by available space. These components preferably include the battery 185, battery terminals 190, an amplifier integrated circuit 195 and potentiometers 200. In preferred embodiments, the components further include one or more of the following components for improved performance: a manual volume control, an automatic gain control circuit, an adjustable peak clipping circuit, a tone control, a control-programmable volume control, and a set screw volume control.

Assembly of the preferred embodiment is now described. The break-away nipple 130 is placed into the female receptacle 140 on the housing 135. As mentioned above, the break-away nipple 130 encloses an extension 132 of the receiver tube 125. The circuit holder 155 snaps into the body housing 135 and holds the nipple 130 firmly in place. Thus an output path from the receiver component 160 is provided to the tip of the break-away nipple 130. The output of the receiver component 160 consists of sound pressure waves and is able to travel through the break-away nipple 130 which is now housed inside the housing's female receptacle 140. The break-away nipple is then connected the receiver tube 125 as described in more detail below. Thus, after travelling through the break-away nipple 130, the output is able to enter the receiver tube 125 of the ear mold 100. With the mold 100 and the housing 135 thus connected together, the receiver tube 125 delivers the output of the electronic receiver component 160 to the eardrum.

Other details of the preferred embodiment are now described. Preferably the circuit holder 155 also holds a pierced ear stud-pin 205 in place. The adjustable stud-pin 205 fits into a vertical slot 210 on the housing 135. The stud pin 205 is able to move vertically in the vertical slot 210 in order to align with a wearer's pierced-ear hole on the wearer's earlobe. When the circuit holder 155 is snapped into the housing 135, the backside of the circuit holder 155 places pressure on the head 215 of the stud-pin. The pressure of the housing 135 and the circuit holder 155 together inhibit the movement of the stud-pin. Thus the stud-pin 205 is held snug but is still able to be adjusted vertically.

Alternatively, referring to FIGS. 2A–2E, the stud-pin 205 has a give-way feature that allows the stud-pin to change its orientation if the housing 135 suffers a sharp impact due to a fall or a snag. The give-way stud-pin is able to change its orientation because its head 215 has a ball shape. The give-way head is able to move vertically in the slot 210. With the give-way head at any one point in the slot, the give-way stud-pin is able to trace nearly a half-sphere of freedom of movement, providing an additional margin of safety against injury. Preferably, the circuit holder 155 then also has a ball-accepting groove 212 that corresponds to the housing's groove 210. Under pressure as described above when the circuit holder is attached to the housing, the head 215 encounters resistance from the housing and circuit holder. The resistance is sufficient to secure the housing to the earlobe under regular use but is insufficient to hold the stud-pin so rigidly as to lead to injury to the earlobe in the event of a fall or a snag.

In addition (FIG. 1), the circuit holder 155 preferably holds the battery 185 in a pre-formed indentation. When placed into the indentation, the battery is intended to fit only with its positive side exposed. When the battery is placed properly into the indentation, the earring cover 180 holds the battery in place. If the battery is placed upside-down in the indentation, the earring cover 180 does not fit properly onto the housing 135.

Furthermore, when the circuit holder 155 is open for view with the earring cover 180 removed, preferably only the battery 185 and the two potentiometers 200 are exposed. Preferably all of the other electronic components are placed unexposed under the bottom side of the circuit holder 155.

In this preferred embodiment, a wearer is fitted by a qualified dispenser in the following way. First, a deep impression of the ear is made. The mold is then custom-tailored from the impression and a properly configured circuit is provided for the circuit holder. For wearing, the completed custom-tailored mold 100 is placed into the wearer's ear canal. The break-away nipple 130 is placed into the female receptacle 140. The break-away nipple's receiver tube extension 132 is connected to the electronic receiver component 160. The circuit holder 155 is then snapped into the housing 135. Both the break-away nipple 130 and the stud-pin 205 are sandwiched between the housing 135 and the circuit holder 155 and are thus held in place by pressure.

The battery 185 is placed into the pre-formed indentation and controls such as the potentiometers 200 are adjusted as needed. The earring cover 180 is then attached to, preferably screwed onto, the housing 135. The microphone 165 and the openings 170, 175 all align when the earring cover 180 is completely screwed onto the housing 135.

Figure 3:
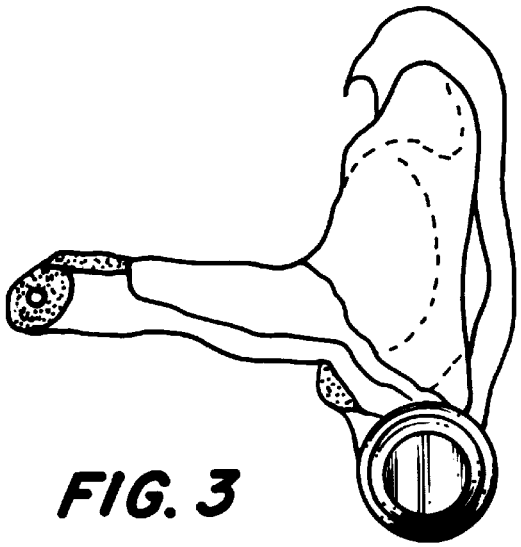
FIG. 3 is a view of an assembled, inserted hearing aid according to the invention.
Figure 4A:
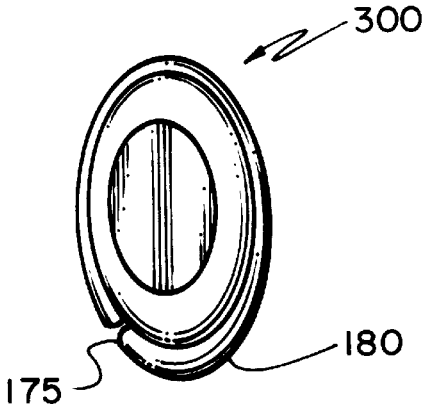
FIGS. 4A and 5A are front plan views of hearing aid covers according to the invention.
Figure 4B:
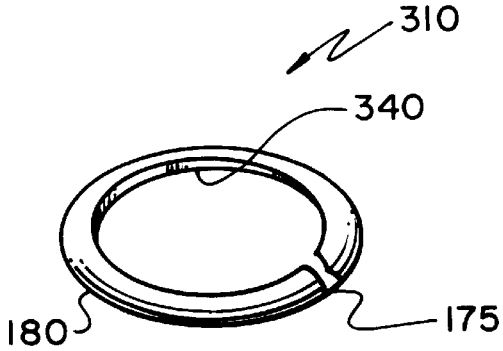
FIGS. 4B and 5B are rear plan views of hearing aid covers according to the invention.
Figure 5A:
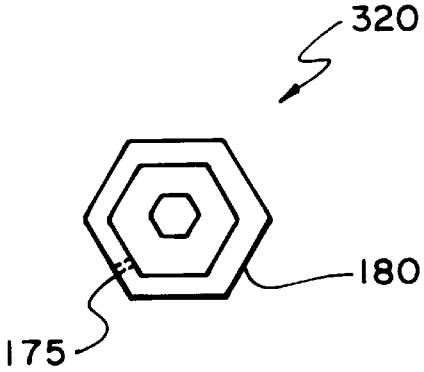
Figure 5B:
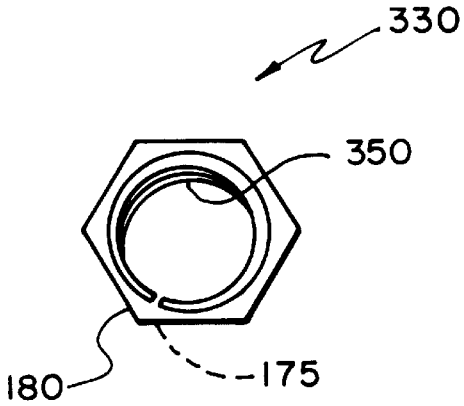

After the housing 135, the circuit holder 155, and the cover 180 are thus connected into one piece, the one piece is then attached to the tube 125 of the mold 100. The break-away nipple 130 thus initially holds the one piece in place. The adjustable stud-pin 205 is then aligned to the wearer's pierced ear hole on the wearer's earlobe and is passed through the earlobe's pierced hole. A stud-clasp 220 is slid onto the stud-pin 205 located behind the wearer's earlobe, completing the securing of the one piece in place. Alternatively, for non-pierced earlobes, an adjustable clip-on fastener 225 is attached to the stud-pin 205. The clip-on fastener is able to slide onto the non-pierced earlobe. Fully assembled and inserted, the preferred embodiment appears as shown in FIG. 3. The housing, with its cover, is positioned on the earlobe and extends above the intertragal notch to conceal the mold.

The earring cover is now described in further detail. FIGS. 4A, 5A and 4B, 5B illustrate front 300, 320 and rear 310, 330 views, respectively, of representative embodiments of the cover 180. As noted above, the cover attaches to the housing preferably by screwing onto the housing with grooves 340, 350 similar to grooves on a bottle cap. The cover is half of a set that also includes a matching actual earring that is worn on the unaided ear to complete the appearance of a set of earrings. In the preferred embodiment, the cover is selected from a collection of interchangeable covers, each of which makes up a set with a matching actual earring. The collection is provided so that the wearer is able to change the appearance of the housing to make, through aesthetic variety and fashion coordination, the hearing aid even less conspicuous. For example, the wearer is able to don a different cover and matching earring each day, which gives the appearance of simply wearing a different set of earrings each day. In another example, when the wearer has an occasion to change clothing from daytime clothing to eveningwear, the wearer is able to also change from one cover and matching earring set that matches the daytime clothing to another cover and matching earring set that matches the eveningwear.

Each cover in the collection is similar in that each cover is able to be screwed onto the housing to protect the components of the circuit holder. Each cover also preferably has the opening 175 so that the cover does not block the microphone sufficiently to impair the operation of the hearing aid. In a preferred embodiment, each cover is made from one of the following materials or a combination: injection-molded plastic, metal, wood, and gemstones. In general, each cover may be made from any material that is appropriate for constructing an earring and may take any shape that provides for attachment, protection, and non-blockage as noted above. For example, the cover can be round or polygonal, as shown in FIGS. 4A, 4B and 5A, 5B.

Figure 6:
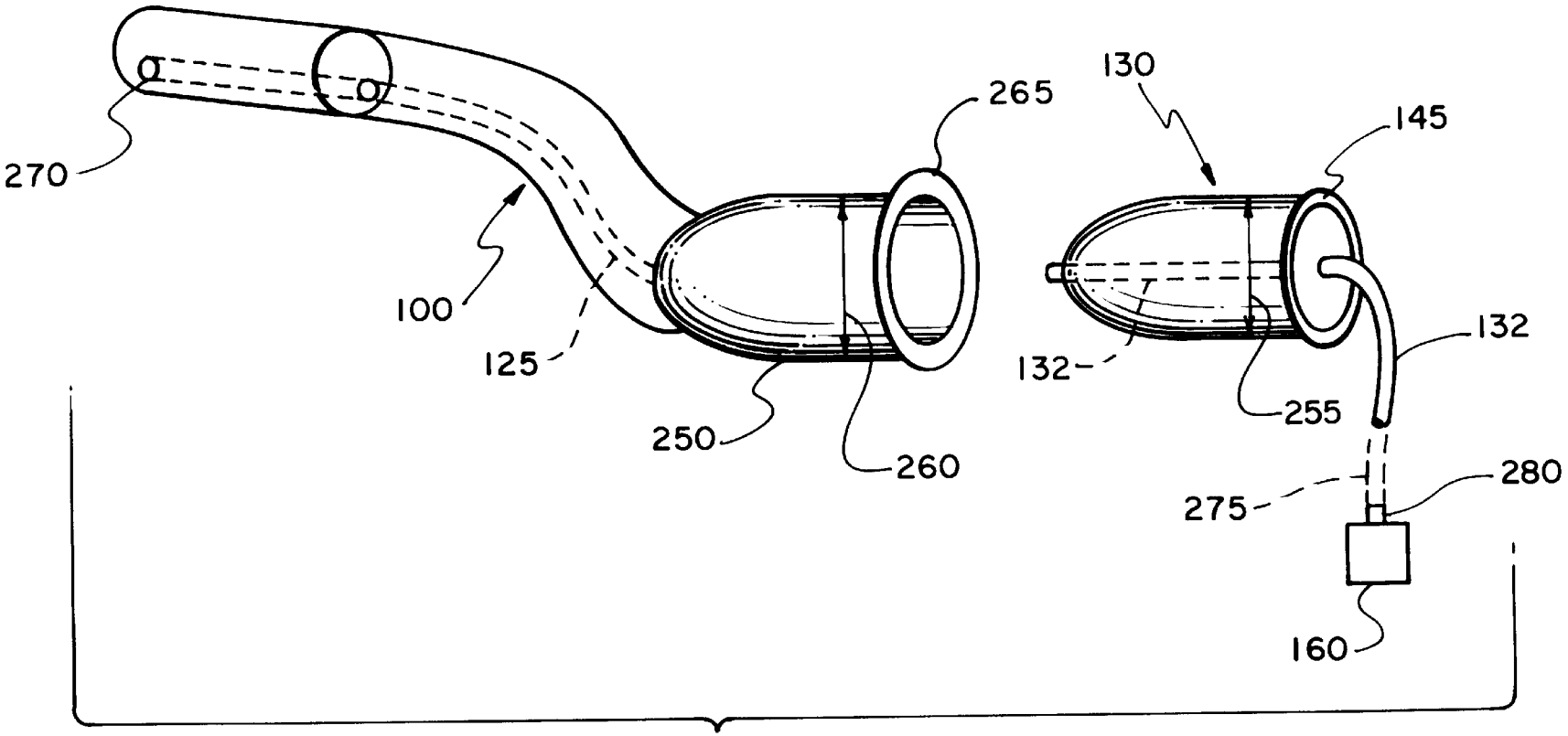
FIG. 6 is a somewhat diagrammatic view of a disassembled hearing aid connector according to the invention.

Turning now to FIG. 6 (not to scale), the break-away nipple 130 and its connection to the mold 100 and receiver 160 are now described in further detail. The mold includes an entrance 250 that receives the break-away nipple 130 to connect the mold's receiver tube 125 to the tube extension 132. The nipple 130 is small, e.g., 0.375 inches in length, and has a bullet shape that allows the nipple to slide into the entrance 250 much as a plunger slides inside a syringe housing. The bullet shape of the nipple preferably provides that nearly all of the nipple has a diameter 255, e.g., 0.25-inch, that is substantially the same as the diameter 260 of the entrance 250. Thus, even if the nipple is inserted only partially into the entrance, the nipple and entrance provide a seal that allows the output of the receiver 160 to be workably delivered through the nipple to the tube 125.

Preferably, however, the nipple is inserted fully into the entrance. To aid insertion, a receiving ridge 265 is provided on the entrance. The receiving ridge operates much like a funnel such that the break-away nipple is guided into the entrance. Thus, a nipple that approaches the entrance in a slightly misaligned fashion is guided by the receiving ridge into improved alignment, allowing proper insertion. When the nipple is fully inserted, the output of the receiver 160 is able to travel through the nipple's tube extension 132 and through the mold's tube 125, arriving at a point 270 proximal to the eardrum.

In this embodiment, the entrance 250 is preferably made with a combination of acrylic and vinyl-flex such that the entrance is (1) soft enough to avoid damage to the ear, as mentioned above, and also (2) strong enough to structurally receive the nipple. Other materials that also provide flexibility and strength may be used.

Figure 7:
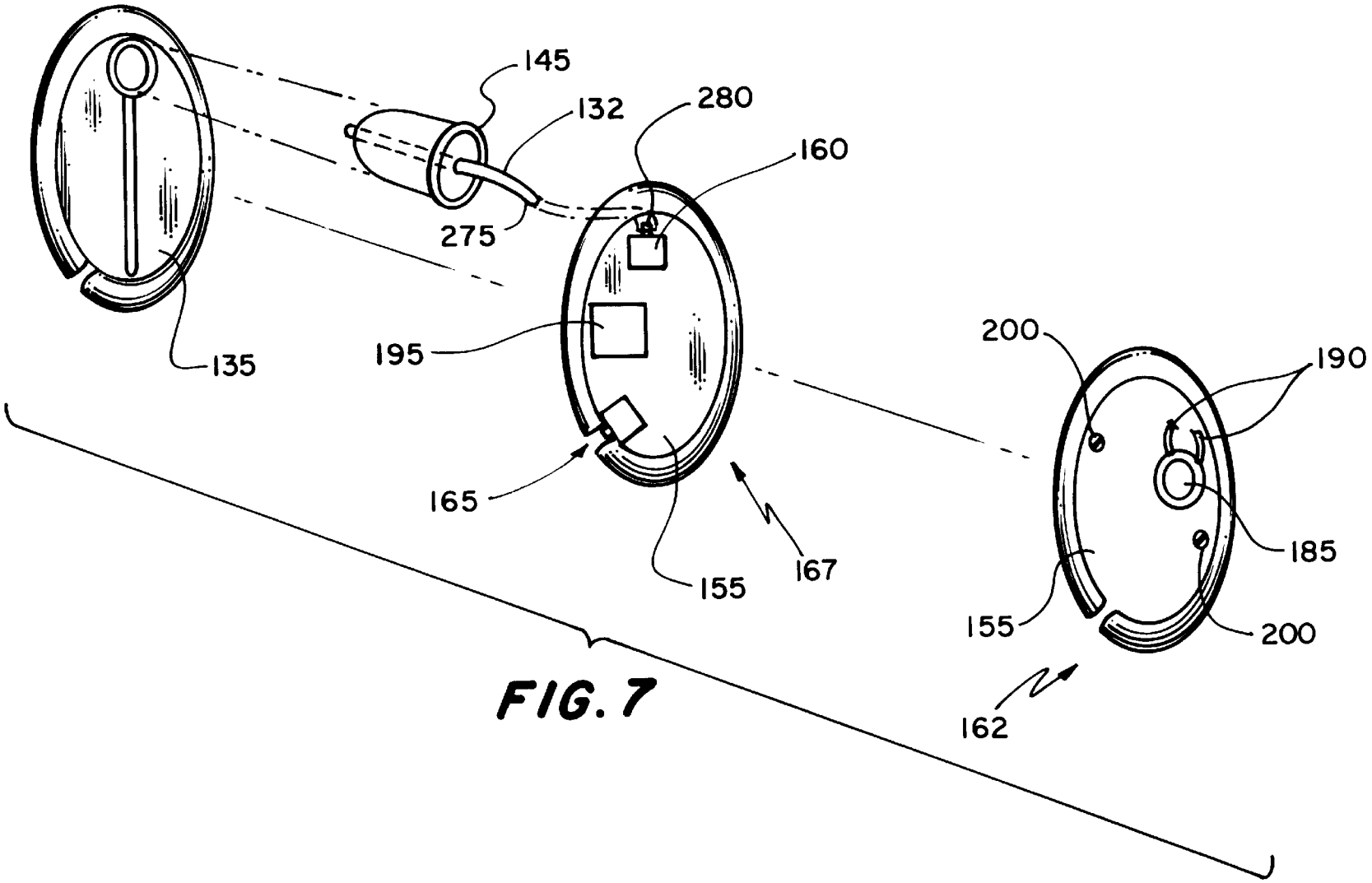
FIG. 7 is a detailed diagrammatic view of a disassembled portion of a hearing aid according to the invention.

With reference now to FIGS. 6 and 7 for a discussion of the connection of the nipple to the receiver 160, the housing 135, and the circuit holder 155 are shown in a disassembled state in FIG. 7. With the cover removed (normal view 162), only the potentiometers 200, the battery 185, and the battery's terminals 190 are visible. These visible parts are preferably of rugged construction. In FIG. 7, to illustrate the circuit holder's components, a transparent view 167 of the circuit holder 155 is provided. The circuit holder includes the microphone 165, the integrated circuit 195, and the electronic receiver 160. The receiver is connected to the break-away nipple with a connecting portion 275 of the extension tube 132. The connecting portion 275 fits snugly over an output port 280 of the receiver 160 much as a sleeve fits over a tube. Preferably a rubber jacket is then placed over the receiver to prevent internal feedback leakage. Another rubber jacket is preferably used near the microphone 165 for the same purpose.

Figure 8:
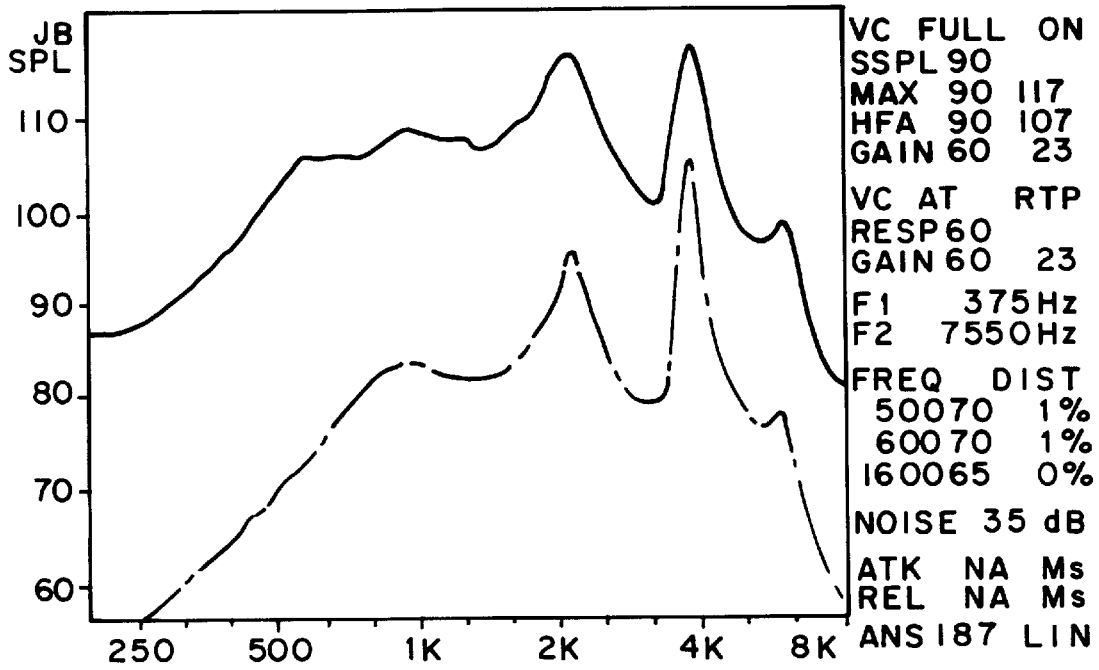
FIGS. 8 and 9 are graphs displaying results of tests of a hearing aid according to the invention.
Figure 9:
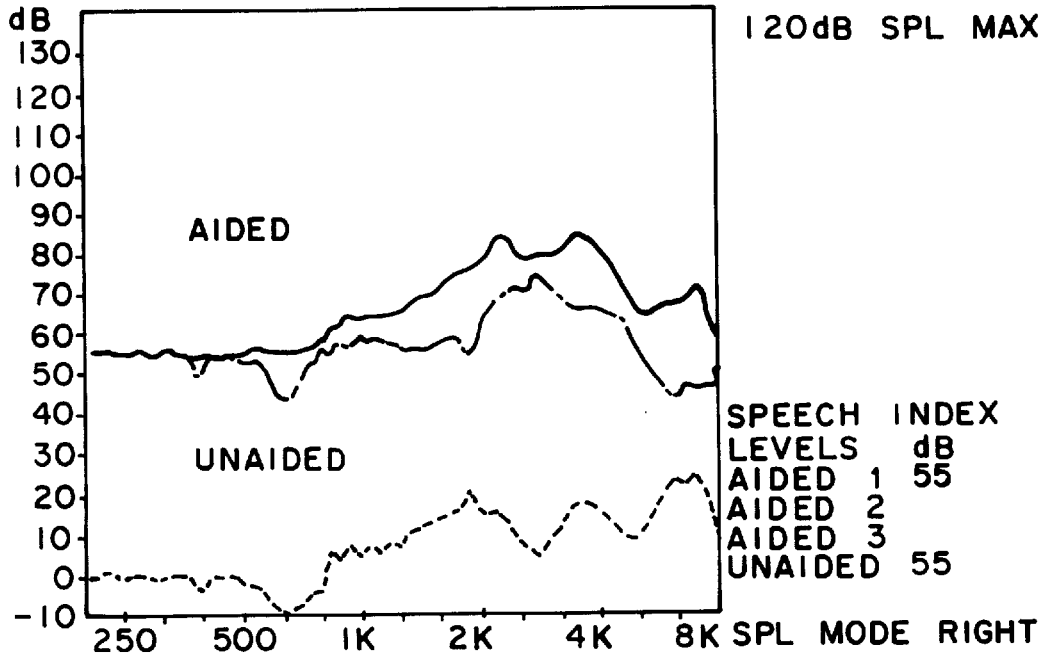

The output of tests of a hearing aid produced according to the preferred embodiment of the invention are shown in FIGS. 8 and 9. With respect to FIG. 8, subjected to an industry-standard ANSI test on a "Real Ear" computer, the hearing aid produces a 23 dB gain at full volume with an audio signal that arrives at the microphone and is amplified and delivered to the eardrum. Furthermore, the hearing aid produces frequency distortions of levels of 1%, 1%, and 0% at frequencies of 500 Hz, 800 Hz, and 1600 Hz, respectively. According to industry standards, this gain and these distortion levels indicate a high-performance hearing aid.

With respect to FIG. 9, the performance of the hearing aid is shown contrasted with an unaided ear. In the test of FIG. 9, a test probe of the "Real Ear" computer was placed inside a human ear and readings were taken with and without the aid of the hearing aid, which was set at low volume. As shown, the hearing aid produces a significant increase in sound level at nearly all frequencies.

Other embodiments are within the scope of the following claims. For example, one or more of the electronic components may be positioned near the eardrum instead of outside the ear canal. In such a case, an electronic or optical signal may be transmitted to a location near the eardrum, where the electronic or optical signal is converted to sound pressure waves. The electronic or optical signal may be analog or digital and may be derived from a signal originating at the microphone outside the ear canal. The transmission may be implemented with the use of an electrical wire, an optical fiber, or electromagnetic waves such as radio or infrared waves. In the case of an electrical wire or an optical fiber, the break-away nipple further includes an electrical or optical connector and is used to provide a electrical or optical connection.

What is claimed is:

1. A hearing aid comprising a microphone for generating a signal;

an amplifier configurable to receive a signal for producing an amplified signal;

control means adapted to control said amplifier;

a receiver configured to receive said amplified signal and to generate a sound pressure signal;

a connector configurable to receive said amplified signal for conducting said sound pressure signal, said connector having an inner member and an outer member, said inner member being removably insertable into said outer member, said connector being able to conduct said sound pressure signal when said inner member is at least partially inserted into said outer member, said connector forming a breakaway nipple;

a conduit configurable to extend into the ear canal, said conduit configurable to receive said amplified signal from said connector for conducting said amplified signal to an area proximal to the eardrum;

a substantially flat circuit holder adapted to carry and electrically connect electronic components including said microphone, said amplifier, said control means, and a battery; and a housing to contain said circuit holder and electronic components, adapted to be attached solely to an ear lobe, said housing having a female receptacle for housing the breakaway nipple and the outer member.

2. The hearing aid of claim 1, wherein the amplifier, when physically connected to the conduit, is able to be completely physically disconnected from the conduit by applying a force to the amplifier, said force being sufficient to remove the inner member from the outer member.

3. The hearing aid of claim 2, wherein the amplifier's disconnectability from the conduit is sufficient to prevent the force applied to the amplifier from causing an injury proximal to the conduit.

4. The hearing aid of claim 1, wherein the amplified signal comprises sound pressure waves; and the connector conducts sound pressure waves.

5. The hearing aid of claim 1 further comprising a pin configurable to attach the amplifier to the earlobe, the pin being at least vertically movable with respect to the amplifier.

6. The hearing aid of claim 1, wherein the conduit comprises a flexible plastic material.

7. The hearing aid of claim 1, wherein a substantial portion of the conduit is configurable to fit along the bottom of the ear canal, the ear canal thus being left substantially unfilled, the conduit substantially filling the ear canal only at the area proximal to the eardrum.

8. The hearing aid of claim 7, wherein the conduit comprises a tube for conducting the amplified signal to the area proximal to the eardrum.

9. The hearing aid of claim 1, wherein the inner member comprises a flexible plastic material.

10. The hearing aid of claim 1, wherein the outer member comprises a ridge that facilitates insertion of the inner member into the outer member.

11. A hearing aid comprising:

a microphone for generating a signal;

an amplifier; configurable to receive a signal for producing an amplified signal;

control means adapted to control said amplifier;

a receiver configured to receive said amplified signal and to generate a sound pressure signal;

a sound-conducting connector configurable to receive said sound pressure signal for conducting said sound pressure signal, said connector having an inner member and an outer member, said inner member being removably insertable into the outer member and forming a breakaway nipple;

a conduit configurable to extend into the ear canal, said conduit configurable to receive said sound pressure signal from said connector for conducting said sound pressure signal to an area proximal to the eardrum;

a substantially flat circuit holder adapted to carry and electrically connect electronic components including said microphone, said amplifier, said control means, and a battery;

a housing to contain said circuit holder and electronic components, adapted to be attached to an ear lobe, said housing having a female receptacle for housing the inner and outer members; and cosmetic jewelry attached to said housing, concealing said circuit holder.

12. The hearing aid of claim 11, wherein the cosmetic jewelry comprises a hearing aid cover for the amplifier, said cover comprising an earring portion; and a connector portion for removably attaching said earring portion onto said amplifier.

13. The hearing aid of claim 12, wherein the amplifier further comprises a microphone opening and said cover further comprises a cover opening corresponding to said microphone opening.

14. The hearing aid of claim 12, wherein the connector portion comprises threads for removably screwing the earring portion onto the amplifier; and the cover opening aligns with the microphone opening when the connector portion is fully screwed onto the amplifier.

15. The hearing aid of claim 12, wherein the cover comprises injection-molded plastic.

16. The hearing aid of claim 12, wherein the cover comprises a gemstone.

17. The hearing aid of claim 12, wherein the cover is selected from a group consisting of a plurality of covers, each said cover in said group having an appearance that is unique within the group.

18. The hearing aid of claim 17, wherein each cover in the group corresponds to an actual earring that matches the cover in appearance.

* * * * *